United States Patent [19]

Hattori

[11] Patent Number: 4,553,550

[45] Date of Patent: Nov. 19, 1985

[54] PERSONAL WEARING ARTICLE

[75] Inventor: Morihisa Hattori, Suita, Japan

[73] Assignee: Nikko Kakoozai Co., Ltd., Suita, Japan

[21] Appl. No.: 256,565

[22] Filed: Apr. 22, 1981

[30] Foreign Application Priority Data

Jun. 26, 1980 [JP] Japan ..... 55-86958

[51] Int. Cl.[4] ..... A41C 3/00

[52] U.S. Cl. ..... 128/505

[58] Field of Search ..... 128/477, 478, 479, 480, 128/481, 505, 150, 132

[56] References Cited

U.S. PATENT DOCUMENTS

| | | | |
|---|---|---|---|
| 1,783,512 | 12/1930 | Mather | 128/505 |
| 2,553,825 | 5/1951 | Langs | 128/505 |
| 2,596,567 | 5/1952 | Langs | 128/505 |
| 2,728,079 | 12/1955 | Williams | 128/477 |
| 3,191,602 | 6/1965 | Sturges | 128/477 |
| 3,244,175 | 4/1966 | Sturges | 128/480 |
| 3,934,593 | 1/1976 | Mellinger | 128/480 |
| 4,333,471 | 6/1982 | Nakai | 128/505 |

FOREIGN PATENT DOCUMENTS

| | | | |
|---|---|---|---|
| 1406005 | 6/1965 | France | 128/480 |
| 47-12131 | 6/1972 | Japan . | |
| 50-108628 | 2/1975 | Japan . | |
| 836238 | 4/1952 | Netherlands | 128/150 |

*Primary Examiner*—Doris L. Troutman

*Attorney, Agent, or Firm*—Armstrong, Nikaido, Marmelstein & Kubovcik

[57] ABSTRACT

A personal wearing article comprises a main body, for example, a garment having loops or hooks on the inner surface thereof, a retainer having hooks or loops on the front side thereof engageable with the loops or hooks on the main body, and a pressure sensitive adhesive agent layer provided on the back side of the retainer for sticking the retainer on the human body.

18 Claims, 64 Drawing Figures

PERSONAL WEARING ARTICLE

BACKGROUND OF THE INVENTION

The present invention relates to a personal wearing article, which is worn next to the skin, such as stockings, partial wigs, women's bathing suits, women's breast covering undergarments, and women's privates coverings, and more particularly it relates to a personal wearing article comprising fastening means 2 on the inner surface of a personal wearing article main body 1 which is worn next to the skin, mating fastening means 4 fastenable to said fastening means 2 and positioned on the face side of a sheet-like retainer 3 positioned on the body side of the personal wearing article main body 1, and a pressure sensitive adhesive agent layer 5 to be stuck on the wearer's body.

The personal wearing articles referred to herein include ballet suits, gym suits, and tank top dresses and brassieres without shoulder strings, and wrist watches, eye bandages, masks, and sweat absorbers applied to the armpits, in addition to the articles mentioned above. In order to hold stockings, bathing suits and other personal wearing articles which are worn next to the skin, so as to prevent them from deviating from their predetermined positions, it has heretofore been proposed to use adhesive agents to fix these articles to the skin. In such case, however, the adhesive agent sticks to the personal wearing article and each time the article is used, dust or the like sticks to the remaining adhesive agent, causing the latter to become hard, thus making it impossible to wear the article so many times.

As for women's stockings, conventionally they are prevented from slipping down by tightening their upper ends by annular rubberbands. In order to keep them from slipping down for a long period of time, however, a relatively high elastic tightening force is required, which poses a problem that such high tightening force impedes blood circulation. Thus, it has been necessary to use separate means, such as garter belts, for suspending the stockings. Partial wigs, which are popular now, are adapted to be attached directly to the head skin by an adhesive agent, which tends to stick to the back side of the partial wig, interfering with the reuse of the wig. It is troublesome to remove the adhesive agent which has stuck to the wig.

If one wearing a wide-cut suit, such as a bathing suit, ballet suit or gym suit, moves one's body, the garment, such as the bathing suit, is moved relative to the wearer's body to create an undesired clearance between the hems of the garment and wearer's body, causing the pubic hair to appear through the clearance. For this reason, people are some reluctance or uneasiness in wearing such wide-cut garment as bathing suits. A cylindrical dress in the form of a tank-top dress minus the shoulder strings and a brassiere which has no shoulder strings are known, and they are designed to be worn on the body around the breasts with a relatively low elastic tightening force which does not impede blood circulation, so that there are disadvantages that they tend to slip down upon movement of the wearer's body and that they are liable to be worn out of shape.

In recent years, there has been a trend to make bathing suits and tights thinner and thinner to provide improved fashionability and wearing quality, but such thinning has the danger of the women's privates or pubic region being seen through. For this reason, it has been contemplated to provide a covering cloth strip which may be removably attached to the region of the back side of a bathing suit or tights which conceals the privates or pubic region, by a pressure-sensitive adhesive agent, so that it may be replaced by a new one whenever it becomes dirty or discolored after its repeated use. Such covering cloth strip, however, would move together with the bathing suit or tights, having the following drawbacks.

When one wearing such bathing suit or tights moves one's body, the covering cloth strip is moved together with the suit or tights relative to the wearer's body, thus failing to perform its function of concealing the pubic region, causing the pubic hair to appear beyond the hems of the suit or tights. Further, the presence of a layer of adhesive agent on the covering cloth strip does not allow reuse of the strip once it is laundered.

For women, the shape of the breast is of no small concern. For example, the bulged shape of the nipples being seen through a thin garment or the breasts drooping down detracts greatly from the style of women. These phenomenon are worrying women. For this reason, brassieres have heretofore been used. Brassieres will constrict the bust, with their shoulder strings locally pressing the shoulders, thus impeding blood circulation. In spite of these disadvantages, brassieres are in wide use in order to correct the shape of the breast and prevent the shape and color of the nipples to be seen through the garment. However, there are many women who want to free themselves from the feeling of oppression due to constriction from the brassiere. For this reason and also for reasons of fashion, a no-brassiere style is in fashion. That is, when women wear a so-called tank top dress, which leaves the shoulders and bust naked, they go no-brassiere. However, those women who have unshapely or drooping breasts are, of course, reluctant to go no-brassiere. Another reason for reluctance is that the nipples can be seen through the garment.

Thus, there has heretofore been proposed means for correcting the shapes of the breasts or preventing the bulged shape of the nipples from being seen through the garment, by sticking coverings on the nipples on breast by a pressure sensitive adhesive agent. Such nipple or breast coverings, however, cannot be reused once they are laundered, because the pressure sensitive adhesive agent applied to the back side thereof is degraded by laundering.

SUMMARY OF THE INVENTION

The present invention has been accomplished with the above in mind. A first object of the invention is to provide a personal wearing article which, worn next to the skin, can be held in position easily and positively without causing displacement thereto, while having no possiblity of an adhesive agent sticking to an associated personal wearing article main body, and which can be worn a number of times.

A second object of the invention is to provide a personal wearing article, wherein a garment worn next to the skin, such as a bathing suit, can be kept from moving relative to the wearer's body, even if the latter is moved, to prevent the pubic hair from inadvertently appearing beyond the hems of the bathing suit or prevent formation of a clearance which allows the body to be seen, and wherein even a bathing suit which is wide-cut can be worn with a feeling of security or even a tank-top dress or a shoulder-stringless brassiere can be worn without the danger of slipping down or getting out of shape.

A third object of the invention is to provide a personal wearing article wherein fastening means provided on an associated garment is rationally constructed so that it is capable of retaining its function for a long period of time without deterioration in ability to fasten the wearing article to the human body as seen in the conventional wearing article to which an adhesive agent is directly attached.

A fourth object of the invention is to provide a personal wearing article which can be positively held on the wearer's body without detracting from the touch of the article worn next to the skin.

A fifth object of the invention is to provide a privates covering designed to cover the privates without being moved relative to the latter, even if a garment worn thereover, such as a bathing suit or tights, is moved relative to the wearer's body.

A sixth object of the invention is to provide a breast undergarment which is capable of correcting the shape of the breast by a breasts covering and which can be used a number of times.

The invention will be described in more detail with reference to the accompanying drawing illustrating embodiments thereof.

DESCRIPTION OF THE PREFERRED EMBODIMENTS

Figure 1:
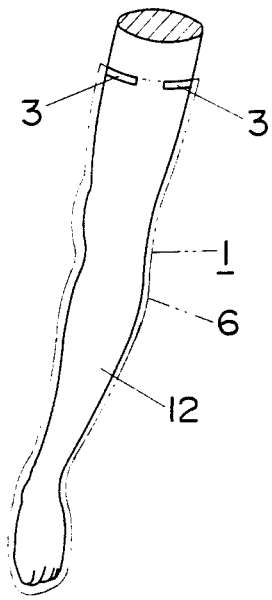
FIG. 1 is a schematic perspective view of a stocking according to an embodiment of the present invention, in its worn position.
Figure 2A:
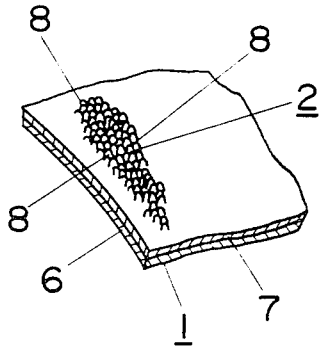
FIGS. 2*a* and 2*b* are an enlarged fragmentary perspective view and an enlarged fragmentary sectional view, respectively, of said stocking.
Figure 2B:
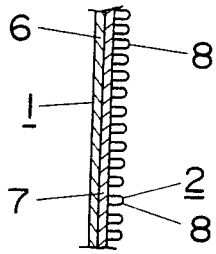
Figure 3A:
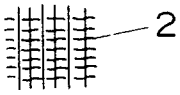
FIGS. 3*a* and 3*b* are an enlarged fragmentary front view and an enlarged sectional view, respectively, of another example of fastening means for said stocking.
Figure 3B:
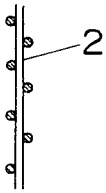
Figure 4A:
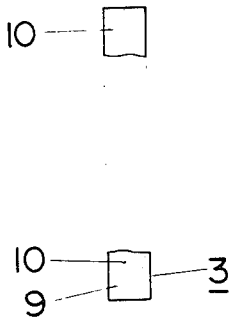
FIGS. 4*a*, 4*b* and 4*c* are a partly omitted front view, an enlarged fragmentary perspective view and an enlarged fragmentary sectional view, respectively, of a retainer for said stocking.
Figure 4B:
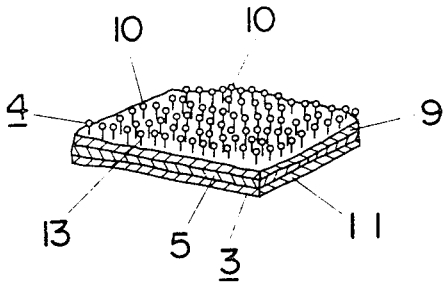
Figure 4C:
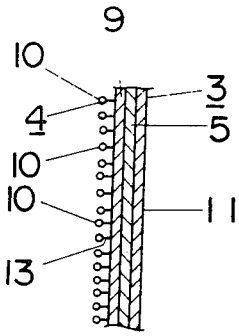
Figure 4D:
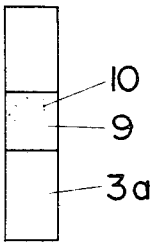
FIGS. 4*d* and 4*e* are a front view and a sectional view, respectively, of another example of a retainer.
Figure 4E:
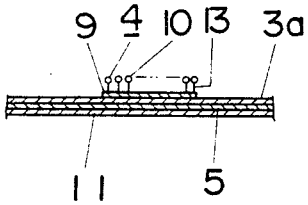

FIG. 1 shows an embodiment of the invention wherein a personal wearing article main body 1 is a stocking 6. Fastening means 2 are disposed on the inner surface of the stocking 6 adjacent the upper open end thereof and circumferentially spaced apart from each other. Such fastening means 2 may be annularly provided around the entire periphery or may be installed to extend downwardly. Alternatively, they may be distributed over a substantial region extending downwardly from the upper end. Such fastening means 2 is made agreeable to the touch. That is, as shown in FIG. 2. the fastening means 2 comprises an infinite number of soft and small loops 8 formed in a nap raising fashion on a base fabric 7. It is preferable that the base fabric 7 be provided with stretchability in one direction, namely, circumferentially of the upper open end of the stocking 6. If the fastening means 2 are small pieces, the stretchability of the base fabric 7 may be dispensed with. Further, as shown in FIG. 3, a woven fabric of coarse mesh size may be used as fastening means 2. In using such woven fabric as fastening means 2, the material fabric of the stocking 6 itself may be used as fastening means 2. Alternatively, a knit fabric may be used as fastening means 2. The numeral 3 denotes a retainer which, as shown in FIG. 4, has mating fastening means 4 in the form of an infinite number of liner rods formed thereon in a nap raising fashion and having front end hooks 10, said retainer also having a pressure sensitive adhesive agent layer 5 applied to the back side thereof for sticking said retainer 3 on the human body 12. As shown in FIGS. 4*d* and 4*e*, the retainer 3 may comprise a belt-like synthetic resin sheet 3*a* having a pressure sensitive adhesive agent layer 5 applied thereto, and a base fabric 9 whose area is smaller than that of said sheet 3*a* and which is heat sealed thereto, so as to sufficiently increase the area for sticking the retainer 3 on the body 12 as compared with the mating fastening means 4 provided on the base fabric 9, thereby increasing the retaining strength of the retainer 3.

Figure 5A:
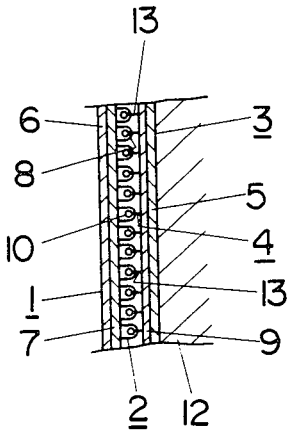
FIGS. 5*a* and 5*b* are enlarged fragmentary sectional views of said stocking, showing how it is used.
Figure 5B:
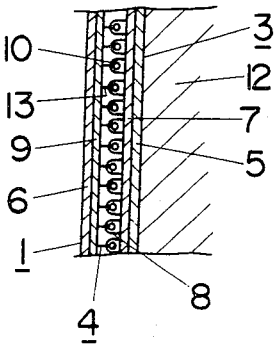

Reverse to the above embodiments, as shown in FIG. 5*b*, the mating fastening means 4 may be in the form of a large number of loops 8 formed in a nap raising fashion, while the fastening means 2 may be in the form of a large number of linear rods 13 having front end hooks 10. Such linear rods 13 having front end hooks 10 are relatively stiff ones made of synthetic resin, while the front end hooks are bulged as illustrated or bent in hook form. In addition, in cases where the mating fastening means 4 is in the form of a large number of loops 8, a base fabric having loops 8 will be sewed or otherwise fixed to the surface of a retainer 3 formed of a synthetic resin sheet, woven fabric, knit fabric, non-woven fabric or the like or will be used as the material for the retainer 3.

While the retainer 3 has been described as being rectangular in the above embodiments, it may be square, round, crescent, star-shaped or the like to improve the aesthetic value of the pattern. The retainer 3 may be skin-colored or it may be other than skin-colored; for example, it may be bright color, such as golden color and silver color, or red, yellow, green, or blue or a mixture of these colors so as to catch the eye for the purpose of fashionability. The numeral 11 denotes a release paper sheet stuck on the pressure sensitive adhesive agent layer 5.

In use, the retainer 3, after having their release paper sheets 11 removed therefrom, are stuck on the human body 12 in the upper portion of the leg through the pressure sensitive adhesive agent layers 5, as shown in the solid lines in FIG. 1. Then, as shown in FIG. 5*a*, the fastening means 2 attached to the inner surface of the stocking 6 is brought into engagement with the mating fastening means 4 attached to the body 12, thereby retaining the open end of the stocking 6 on the body 12. Even if the leg is bent and straightened, therefore, the stocking 6 will not slip down.

Figure 6:
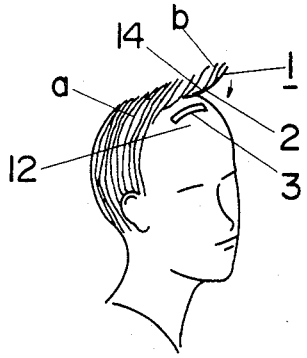
FIG. 6 is a schematic perspective view of a wig according to an embodiment of the present invention, in its worn position.

FIG. 6 shows another embodiment of the invention, wherein the personal wearing article main body 1 is shown as a partial wig 14. Thus, the fastening means 2 provided on the inner surface of the partial wig 14 at the front edge portion will be brought into engagment with the mating fastening means 4 on the retainer 3 held on the body 12 at the forehead, as shown in solid lines, so that the partial wig 14 will not be dislocated no matter how violently the head may be moved. The wig 14 may be complete rather than partial. In FIG. 6, a denotes wearer's hair and b denotes the hairs of the wig 14. In addition, the fastening means 2 attached to the inner surface of the wig 14 may be provided by the lining fabric of the wig 14.

Figure 7:
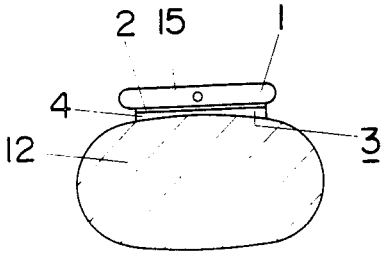
FIG. 7 is a sectional view of a wrist watch without strap according to an embodiment of the invention, in its worn position.

FIG. 7 shows a further embodiment of the invention, wherein the personal wearing article main body 1 is shown as a wrist watch 15. Thus, the fastening means 2 attached to the back side of the case of the wrist watch 15 is brought into engagement with the mating fastening means 4 on the retainer 3 held on the body 12 at the wrist, so that the wrist watch 15 will not fall off the arm no matter how violently the arm may be shaken. According to such arrangement, the strap of the wrist watch 15 is unnecessary.

Figure 8:
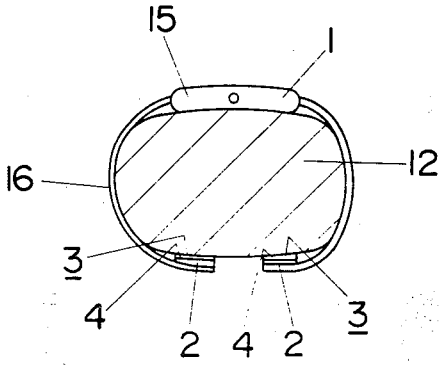
FIG. 8 is a sectional view of a wrist watch with a strap according to an embodiment of the invention, in its worn position.

FIG. 8 shows another embodiment of the invention, wherein the personal wearing article main body 1 is shown as a wrist watch 15 having a strap. Thus, the fastening means 2 attached to the strap 16 of the wrist watch 15 are brought into engagement with the mating fastening means 4 on the retainer 3 held on the body 12 at the wrist, so that the wrist watch will not fall off the arm. According to such arrangement, the connector, such as the buckle, can be eliminated from the strap 16 and the wrist watch 15 can be attached to the wrist without play irrespective of the size of the wrist.

Figure 9A:
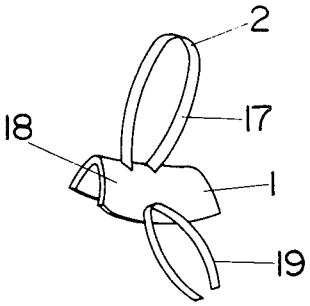
FIGS. 9*a* and 9*b* are a perspective view and an enlarged fragmentary perspective view, respectively, of a sweat absorber according to an embodiment of the invention.
Figure 9B:
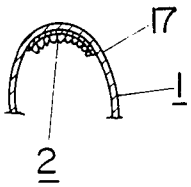
Figure 10:
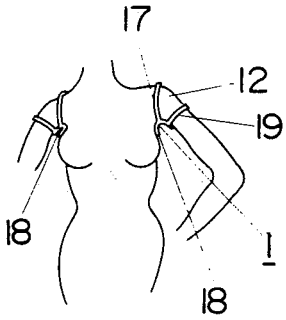
FIG. 10 is a schematic view showing how said sweat absorber is used.

FIGS. 9 and 10 show another embodiments of the invention, wherein the personal wearing article main body 1 is shown as sweat absorbers 18 each having a shoulder string 17 whereby they are suspendedly attached under the armpits. Thus, the fastening means 2 provided on the inner surface of each shoulder string 17 at the top thereof attached to the sweat absorber 18 are brought into engagement with the mating fastening means 4 held on the body 12 at the shoulder, so that the sweat absorbers 18 are suspendedly attached under the armpits and held in position without being dislocated.

The shoulder strings 17 are annular and somewhat stretchable. The shoulder strings 17 may not be annular. The numeral 19 denotes an auxiliary string whereby the saddle-shaped sweat absorber 18 is held attached under the armpit even if the arm is raised.

Figure 11:
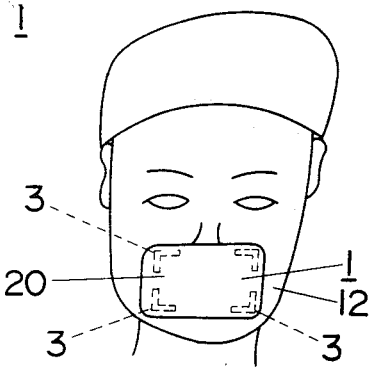
FIG. 11 is a schematic front view of a mask according to an embodiment of the invention, showing how it is used.

FIG. 11 shows another embodiment of the invention, wherein the personal wearing article main body 1 is shown as a mask 20 for covering the nose and mouth. Thus, the fastening means attached to the inner surface of the mask 20 is brought into engagement with the mating fastening means on the retainer 3 held on the body 12 at the face, so that the mask 20 can be used without fastening strings. In addition, strings may be auxiliary used to hold the mask around the mouth.

Figure 12:
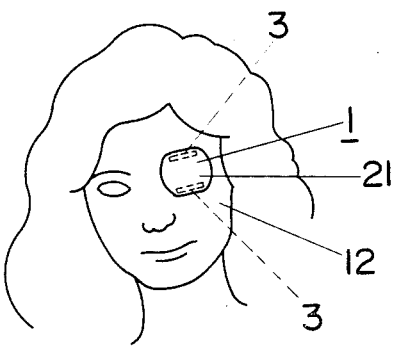
FIG. 12 is a schematic front view of an eye bandage according to an embodiment of the invention, showing how it is used.

FIG. 12 shows another embodiment of the invention, wherein personal wearing article main body 1 is shown as an eye bandage 21 for covering one eye. Thus, the fastening means attached to the inner surface of the eye bandage 21 is brought into engagement with the mating fastening means on the retainer 3 held on the body 12 at the face, so that the eye bandage 21 can be worn without using strings. In addition, strings may be auxiliary used for covering both eyes used when the wearer is sleeping.

While the fastening means has been shown as provided on the personal wearing article main body and the mating fastening means on the retainer in the above embodiments, the mating fastening means may be provided on the personal wearing article main body and the fastening means on the retainer.

As is apparent from the above embodiments, a personal wearing article according to the invention comprises fastening means provided on the inner surface of a personal wearing article main body and in the form of an infinite number of small soft loops or a woven fabric of coarse mesh size and agreeable to the touch, mating fastening means engageable with said fastening means and provided on the surface of a sheet-like retainer positioned undersurface of the personal wearing article main body, and a pressure sensitive adhesive agent layer provided on the backside of the retainer for sticking the retainer on the wearer's body. Thus, by bringing the fastening means or mating fastening means provided on the inner surface of the personal wearing article main body into engagement with the mating fastening means or fastening means on the retainer attached to the wearer's body through the pressure sensitive adhesive agent layer, the personal wearing article can be attached to the wearer's body, so that there is an advantage that the personal wearing article main body can be prevented from being dislocated without impeding blood circulation. Further, there is no possibility of the adhesive agent sticking to or soiling the personal wearing article main body, and there is another advantage that the personal wearing article main body can be used a number of times by simply replacing the old retainer by a new one. Particularly, in cases where fastening means, soft and agreeable to the touch, in the form of a large number of soft loops or a woven fabric of coarse mesh size is provided on the inner surface of the personal wearing article main body, the touch can be improved despite the provision of the fastening means on the inner surface of the personal wearing article main body.

Figure 13:
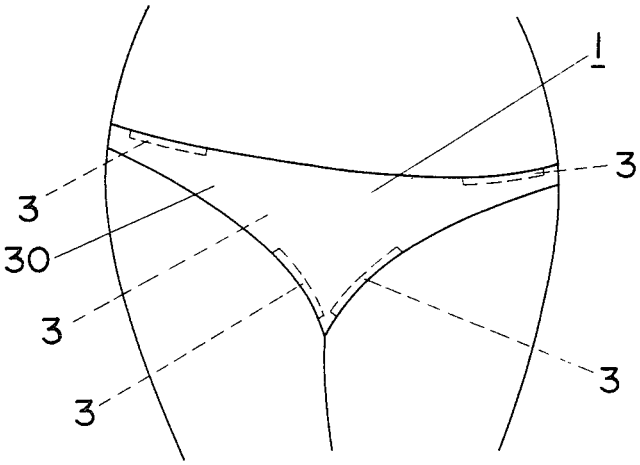
FIG. 13 is a schematic front view of a bathing suit according to an embodiment of the invention, showing how it is used.
Figure 14A:
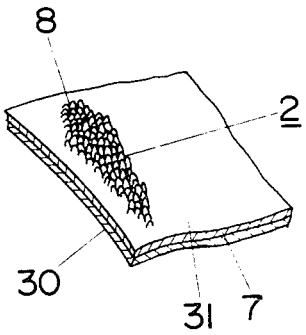
FIGS. 14*a* and 14*b* are a fragmentary perspective view and an enlarged fragmentary sectional view, respectively, of a personal wearing article main body according to an embodiment of the invention.
Figure 14B:
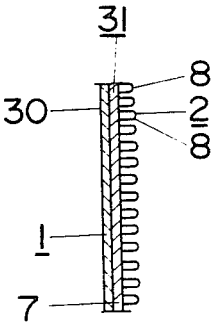
Figure 15A:
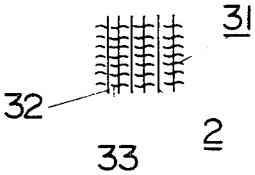
FIGS. 15*a* and 15*b* are an enlarged fragmentary front view and an enlarged fragmentary sectional view, respectively, of another example of a fastening means for said main body.
Figure 15B:
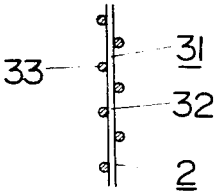
Figure 16A:
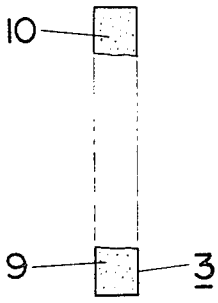
FIGS. 16*a*, 16*b* and 16*c* are a partly omitted front view, an enlarged fragmentary perspective view and an enlarged fragmentary sectional view, respectively, of a retainer for said main body.
Figure 16B:
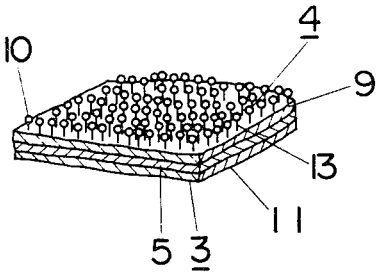
Figure 16C:
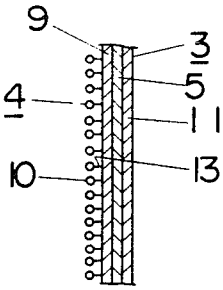

FIG. 13 shows another embodiment of the invention, wherein the personal wearing article main body 1 is shown as a bathing suit 30 and a lining material 31, as shown in FIG. 14, serving as fastening means 2 is sewed to the bathing suit 30. The lining material 31 may be provided substantially entirely or locally on the surface of the bathing suit 30. As for the lining material 31, in order to improve the touch, such a lining material as has a large number of soft and small loops 8 formed on a base fabric 7 in a nap raising fashion is used. In addition, as shown in FIG. 15, a woven fabric of coarse mesh size having warp yarns 32 and weft yarns 33 may be used as a lining material 31, while using said woven fabric as fastening means. Besides this, a lining material in the form of a knit fabric may be used as fastening means. A retainer 3, as shown in FIG. 16, is formed with mating fastening means 4 on one surface thereof by providing a large number of linear rods 13 having front end hooks 10 on a base fabric 19 in a nap raising fashion. The mating fastening means 4 may be constituted by providing on a base fabric a large number of stiff linear rods having their front ends bent in hook form. The back side of the retainer 3 is provided with a pressure sensitive adhesive agent layer 5, which is covered with a release paper sheet 11.

Figure 17:
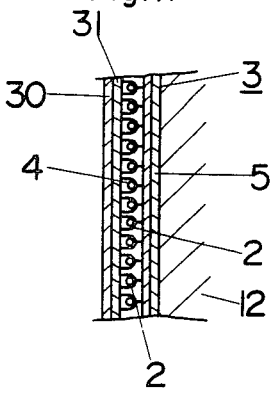
FIG. 17 is an enlarged fragmentary sectional view, showing how said main body is used.
Figure 17:
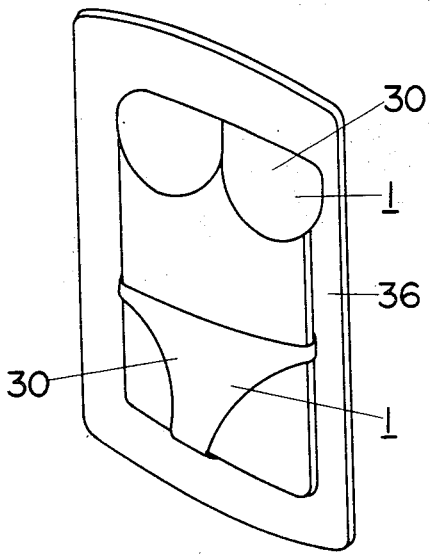
Figure 18:
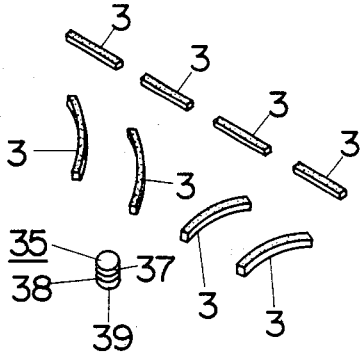
FIG. 18 is an exploded perspective view of a package containing said bathing suit.

The bathing suit 30, as shown in FIG. 18, is packaged together with a number of retainers 3 including spares and put on the market. The package 36 contains test pieces 35, each of which is as large as or smaller than the retainers 3 and comprises a synthetic resin sheet 37 and the same adhesive layer 38 for test purposes on the back side of said sheet 37 as the pressure sensitive adhesive agent layer 5 on the retainer 3, with a release paper sheet 39 applied to said layer 38. Thus, before wearing the bathing suit 30, the user removes the release paper sheets 39 from the test pieces 35 and sticks the latter on the arm and legs to see if the pressure sensitive adhesive agent used will cause skin chapping, eczema or the like to the user. After having ascertained that the pressure sensitive adhesive agent used will not cause allergy to the user, the user removes the release paper sheets from the retainer 3 and stick the latter on the user's body 12 at such portions as the crotch, sides and other places corresponding to the hems of the bathing suit 30, by means of the pressure sensitive agent layers, as shown in chain lines in FIG. 13. Thus, as shown in FIG. 17, the mating fastening means 4 attached to the user's body 12 is brought into engagement with the fastening means 2 which also serves as the lining material for the bathing suit 30, whereby the hems of the bathing suit 30 are held on the body 12. Therefore, no matter how violently the body may be moved, there is no possibility of a clearance being created between the hems of the bathing suit 30 and the body 12.

In addition, the personal wearing articles shown in FIGS. 1 and 6 through 13 are each packaged together with test pieces and put on the market, in the same manner as in the above embodiment.

Figure 19:
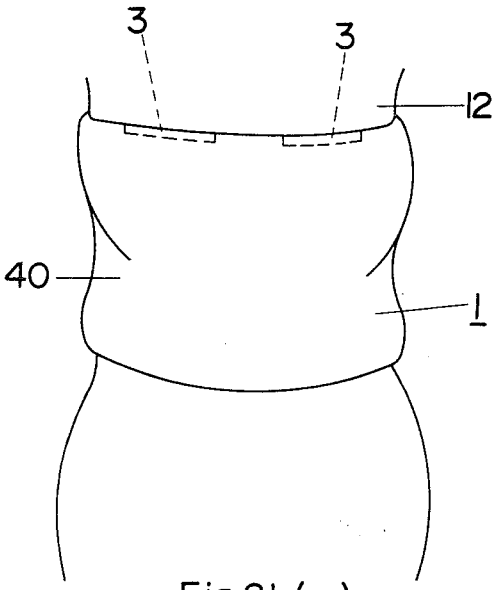
FIG. 19 is a schematic view of a shoulder-stringless dress according to an embodiment of the invention, in its worn position.

FIG. 19 shows another embodiment of the invention, wherein, the personal wearing article main body 1 is shown as a cylindrical dress 40 like a tank top dress having no shoulder strings. Thus, the mating fastening means on the retainer 3 held on the body 12 are brought into engagement with the fastening means which also serves as the lining material for the dress 40, so that the dress 40 will not slip down no matter how violently the body 12 may be moved.

Figure 20:
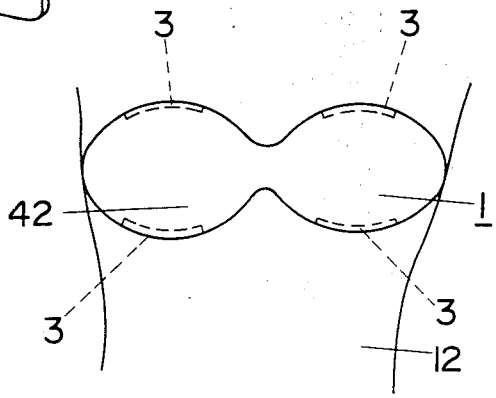
FIG. 20 is a schematic view of a brassiere without shoulder strings and back string according to an embodiment of the invention, showing how it is used.

FIG. 20 shows a further embodiment of the invention, wherein the personal wearing article main body 1 is shown as a brassiere 42 having no shoulder strings and no back strings. Thus, the mating fastening means on the retainer 3 held on the body 12 are brought into engagement with the fastening means which also serves as the lining material for the brassiere 42, so that the brassiere 42 will not slip down no matter how violently the body 12 may be moved. It is so arranged that the shape of the breasts can be corrected by possitively holding the brassiere 42 on the body 12 even if it has no shoulder strings and no back string. In addition, the invention can be also applied to a brassiere having a back string.

In the embodiments described above, the inner surface of a personal wearing article main body, such as a bathing suit, is provided with fastening means soft and agreeable to the touch in the form of a large number of soft and small nap-like loops or a woven fabric of coarse mesh size, while the surface of a sheet-like retainer positioned backwardly of said personal wearing article main body is provided with mating fastening means adapted to be removably attachable to said fastening means, and the inner surface of the retainer is provided with a pressure sensitive adhesive agent layer for sticking the retainer of the human body. Therefore, even if one wearing a garment, such as a bathing suit, ballet suit or gym suit, violently moves one's body, the garment is firmly held on the body and there is no possibility of a clearance being created between the hems of the garment and the body, which allow the pubic hair to inadvertently appear beyond the hems of the garment, and it is possible to prevent the body from being seen through such a clearance. Thus, one can wear such garments with a feeling security. Even a cylindrical tank top dress or brassiere which has no shoulder strings can be kept from slipping down and can be worn without being out of shape. Further, since the fastening means provided on the garment is soft and agreeable to the touch in the form of a large number of soft and small nap-like loops or a woven fabric of coarse mesh size, there is no danger of becoming deteriorated with the lapse of time as in the case of a pressure sensitive adhesive agent and it is capable of retaining its function for a long period of time while providing an improved touch. A further advantage is that garments, such as a bathing suit, can be used a number of times like ordinary garments by simply replacing the retainers.

Figure 21:
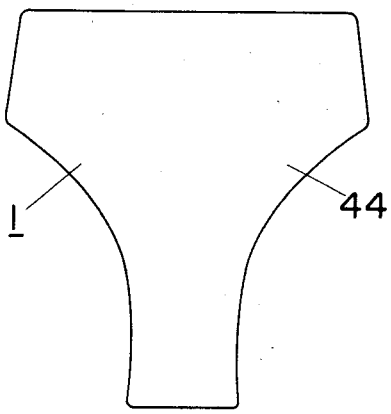
FIGS. 21*a* and 21*b* are a front view and a rear view, respectively, of a privates covering according to an embodiment of the invention.
Figure 21:
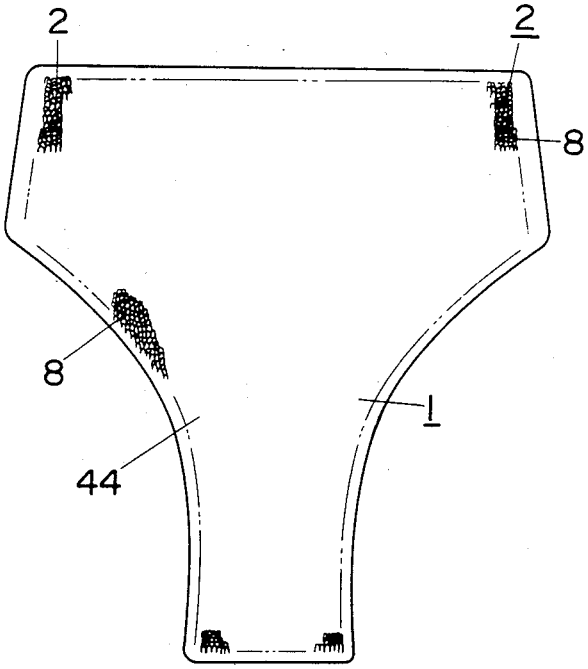
Figure 22A:
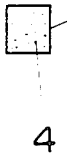
FIGS. 22*a* and 22*b* are a rear view and an enlarged perspective view, respectively, of mating fastening means for said covering.
Figure 22B:
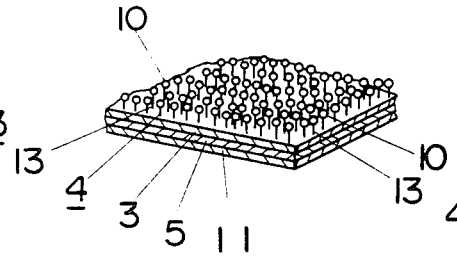
Figure 23:
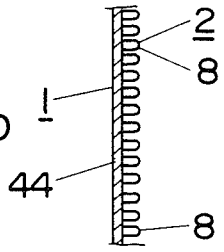
FIG. 23 is an enlarged fragmentary sectional view of a covering belt.
Figure 24:
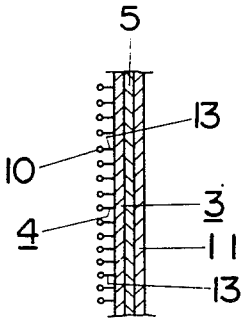
FIG. 24 is an enlarged fragmentary sectional view of a retainer for said covering belt.
Figure 25:
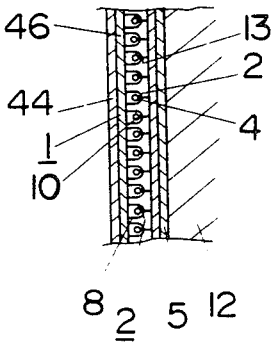
FIG. 25 is an enlarged fragmentary sectional view, showing how said covering belt is fastened.
Figure 27:
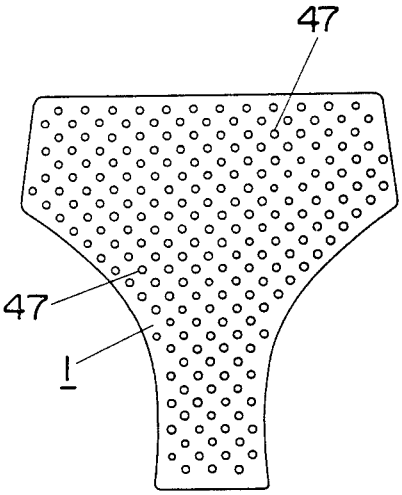
FIG. 27 is a front view of another example of a covering strip.

FIG. 21 shows an embodiment of the invention, wherein the personal wearing article main body 1 is shown as a sheet-like thin covering belt 44 for covering the woman's privates. The covering belt 44 is substantially Y-shaped and formed of a synthetic resin sheet, woven fabric, knit fabric, non-woven fabric or a combination thereof. The back side of the covering belt 44 is provided with fastening means 2. As shown in FIG. 22, the surface of the retainer 3 is provided with mating fastening means 4 removably engageable with said fastening means 3, and its back side is provided with a pressure sensitive adhesive agent layer 5, to which a release paper sheet 11 is applied. The fastening means 2 is in the form, for example, of a large number of nap-like loops, as shown in FIG. 23, and the mating fastening means 4 is in the form of a large number of linear rods 13 having front end hooks 10 removably engageable with said loops 8, as shown in FIG. 14. Reversely, the mating fastening means may comprise a large number of nap-like loops while the fastening means may comprise a large number of linear rods having front end hooks engageable with said loops. The linear rods 13 having front end hooks 10 are relatively stiff ones made of synthetic resin and the front end hooks 10 are bulged as illustrated or bent in hook form. If the fastening means 2 comprises a large number of loops 8, a base fabric 46 having such loops 8, as shown in FIG. 25, is sewed, bonded or otherwise attached to the back side of the covering belt or, as shown in FIG. 23, a material having such loops 8 is used as the material for the covering belt 44. Further, if the covering belt is to be provided with a lining material, a material having a large number of loops 8 may be used as the lining material to serve as the fastening means. On the other hand, if the mating fastening means comprises a large number of loops, a base fabric having such loops on its face side is sewed, bonded or otherwise attached to a retainer formed of a synthetic regin sheet, woven fabric, non-woven fabric or the like or a material having a large number of loops is used as such retainer. The retainer is much smaller than the covering belt and is not particularly limited in shape. In order to prevent the covering belt from becoming stuffy during use thereof, the covering belt 44 having fastening means 2 on the back side may be formed with a number of small holes 47, as shown in FIG. 27. Of course, an air-permeable material may be used.

Figure 26A:
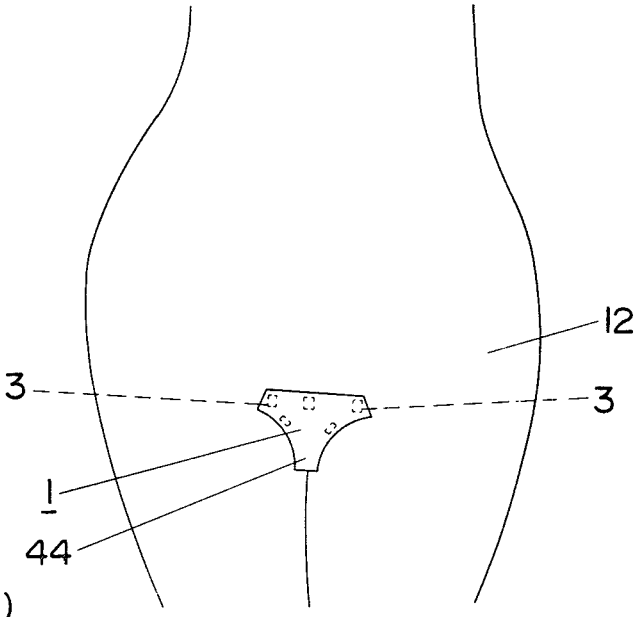
FIGS. 26*a* and 26*b* are schematic views, showing said covering belt in its worn position and a bathing suit worn thereover.
Figure 26B:
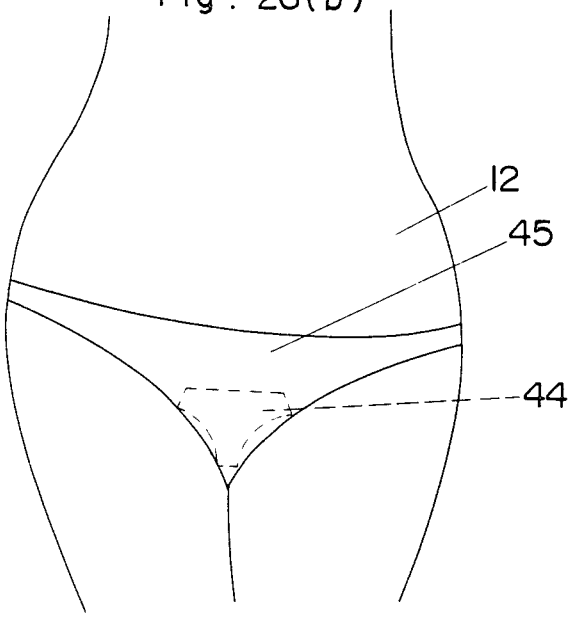

In using the covering belt 44, a plurality of retainers 3 having their release paper sheets removed therefrom are stuck under pressure on the body 12 at places around the privates, as shown in chain lines in FIG. 26*a* and then the covering belt 44 is applied to cover the privates, with the fastening means brought into engagement with the mating fastening means to hold the covering belt 44 on the body 12, as shown in FIG. 26*a*. With the covering belt of the invention thus attached to the body 12, a bathing suit or tights is put on. In this case, the covering belt 44 is held on the body 12 so firmly that despite movement of the bathing suit or tights relative to the body 12 due to movement of the latter, the covering belt 44 is capable of covering the privates as predetermined, and there is no danger of the pubic hair inadvertently appearing beyond the hems of the bathing suit or tights despite violent movement of the body. On the other hand, in reuse, the retainers whose pressure sensitive adhesive agent layers have deteriorated are discarded (or thrown away) and spare retainers are used, whereby the covering belt can be used any number of times.

The color of the covering band is preferably the same as that of the user's skin, but it may be white or whitish or may be the same color as that of the bathing suit or tights. Then, no feeling of incompatibility will be produced even if part of the covering belt 44 is inadvertently exposed beyond the hems of the bathing suit or tights.

Figure 42:
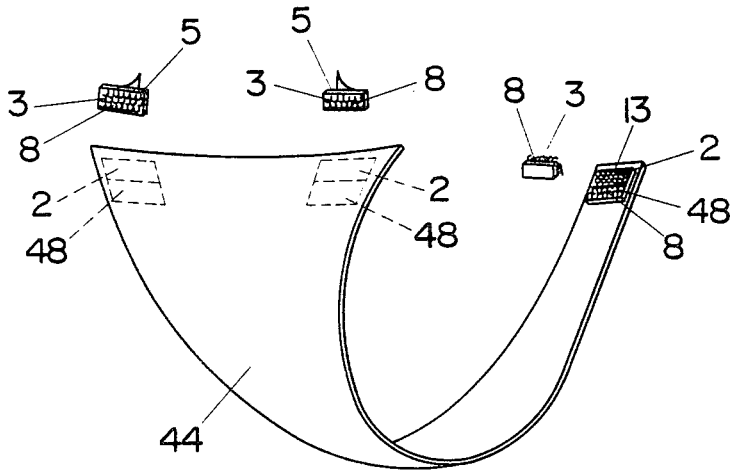
FIG. 42 is a perspective view of a privates covering according to an embodiment of the invention.

FIG. 42 shows an example of privates covering, wherein the front and rear ends of the covering belt 44 are attached to the body 12 by means of retainers 3. The retainers 3 fixed to the front end of the covering belt 44 are stuck on the user's body on the front side thereof adjacent the pubic bone by means of the pressure sensitive adhesive agent layers 5 provided on the back side of said retainers, while the retainer 3 fixed to the rear end of the covering belt 44 is stuck on the user's body on the back side thereof adjacent the coccyx by means of the pressure sensitive adhesive agent layer 5 provided on the back side of said retainer. Therefore, the covering belt is firmly attached at two places to the body 12 to completely cover the woman's privates. Further, since the covering belt is removably fastened to the retainers 3 at the front and rear ends, the front or rear side of the covering belt may be detached to answer the call of nature and then attached again without causing dislocation to the covering belt.

The fastening means 2 fixed to the front and rear ends of the covering belt 44 comprise a large number of linear rods 13 having front end hooks and adapted to be fastened to loops 8 formed on the front surfaces of the retainers 3. The covering belt 44 is also provided with cover strips 48 positioned so that when the covering belt is turned back adjacent the fastening means 2, the cover strips 48 engage the fastening means 2. Thus, fastening means 2 can be covered by said cover strips to prevent the linear rods 13 constituing the fastening means 2 from catching the material of the covering belt 44 or other garments and being damage thereby.

As described above, in cases where the personal wearing article main body is a privates covering, the back side of the sheet-like covering belt for covering the woman's privates is provided with fastening means, while the front side of the sheet-like retainer positioned inwardly of the covering belt is provided with mating fastening means removably fastenable to said fastening means, and the back side of the retainer is provided with a pressure sensitive adhesive agent layer for sticking the retainer on a wearer's body. Therefore, the covering belt for covering the privates is attached to the body, and even if one wears a bathing suit or tights and moves one's body violently to move the bathing suit or tights relative to the body, the covering belt will not move relative to the body, always accurately covering the privates, with no possibility of the pubic hair inadvertently appearing beyond the hems of the bathing suit or tights owing to violent movement of the body. Moreover, since the back side of the covering belt is provided with fastening means and the front side of the retainer is provided with fastening means removably fastenable to said fastening means, there is no possibility of the pressure sensitive adhesive agent sticking to the covering belt or soiling the latter, so that the covering belt can be laundered for use any number of times. Further, since there is no physical connection as by a pressure sensitive adhesive agent between the covering belt and the bathing suit or tights, there is no possibility that the bathing suit or tights is damaged.

Figure 28:
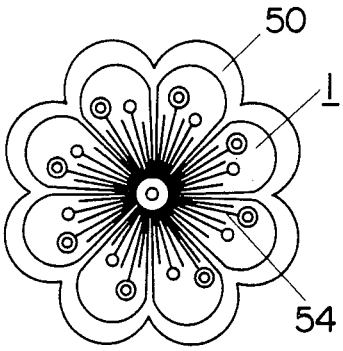
FIGS. 28*a*, 28*b* and 28*c* are a front view, a rear view and an enlarged fragmentary perspective view as seen from the rear, respectively, of a breast covering according to an embodiment of the invention.
Figure 28:
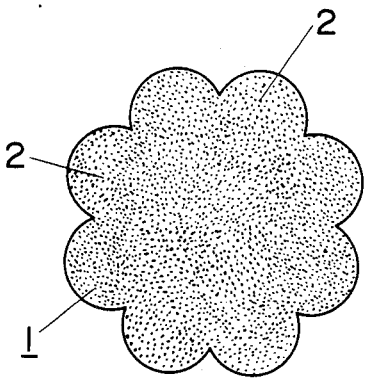
Figure 28:
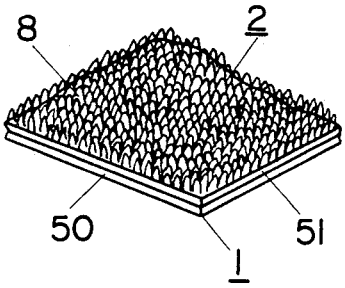
Figure 29:
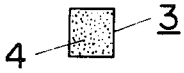
FIGS. 29*a* and 29*b* are a front view and an enlarged fragmentary perspective view as seen from the front, respectively, of a retainer for said covering.
Figure 29:
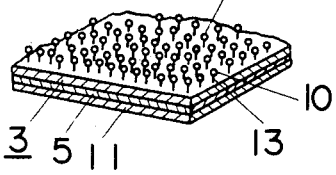

FIG. 28 shows another embodiment of the invention, wherein the personal wearing article main body 1 is shown as a breast covering 50. The breast covering 50 is formed of a synthetic resin sheet, woven fabric, knit fabric, non-woven fabric or a combination thereof. The back side of the breast covering 50 is wholly or partly provided with fastening means 2, while the front side of the retainer 3 is provided with mating fastening means 4, as shown in FIG. 29, which is removably fastenable to said fastening means 2, the back side of said retainer 3 being provided with a pressure sensitive adhesive agent layer 5 which has a release paper sheet applied thereto.

Figure 39:
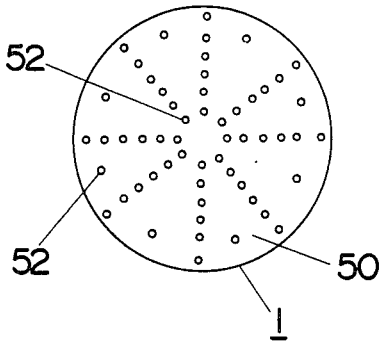
FIG. 39 is a front view of another example of a breast covering.

The retainer 3 is much smaller than the breast covering 50 and is not particularly limited in shape. In order to prevent the breast covering from becoming stuffy during use thereof, the breast covering 50, which has fastening means 2 on the back side thereof, may be formed with a number of small holes 52, as shown in FIG. 39. Of course, an air-permeable material may be used.

Figure 30:
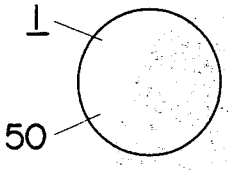
FIGS. 30*a*, 30*b* and 30*c* are front views of other examples of breast coverings.
Figure 30:
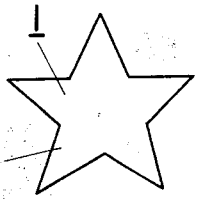
Figure 30:
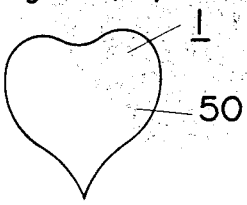

The breast covering 50 shown in FIGS. 28 and 30 has such a size as to cover only the nipple and the region therearound and is used as a nipple covering. The breast covering 50 is a soft sheet and is skin colored or white or whitish so that it will not catch the eye. Reversely, in order to utilize the breast covering as a positive element for fashion, it may be a bright color, such as golden color and silver color, or red, yellow, green or blue or a mixture of these colors. As for the shape of the breast covering 50, it is round, star-shaped, flower-shaped or heart-shaped, but it is not limited to these shapes and any other shape may be used. The breast covering 50 may be provided with an embroidery 54 or other pattern.

The breast covering 50 in the embodiment described above is used in the following manner.

Figure 31:
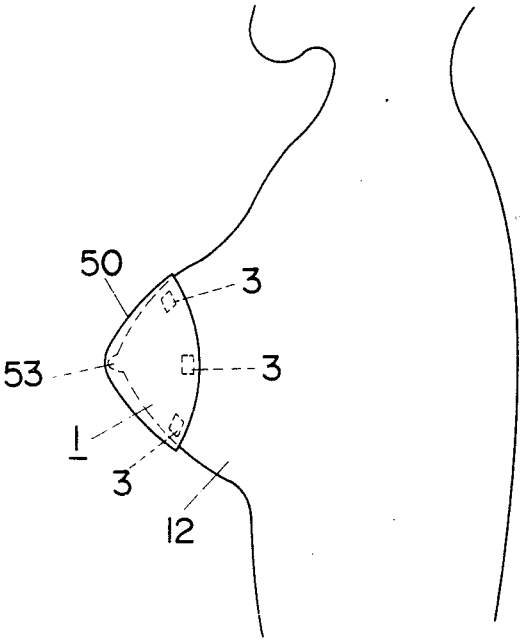
FIG. 31 is a side view, showing how said breast covering is used.
Figure 32:
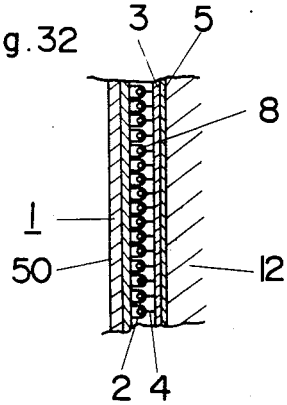
FIG. 32 is an enlarged fragmentary sectional view showing said breast covering in its fastened position.

First, the retainer 3 having the release paper sheet 11 removed therefrom is stuck on and around the nipple 53. In this case, as shown in FIG. 31, a plurality of small retainers 3 may be applied at spaced intervals or an annular retainer, in whole or divided into parts, may be stuck around the nipple 53. Thereafter, the breast covering 50 is applied to cover the nipple 53, with the fastening means 2 fastened to the mating fastening means 4.

Figure 33:
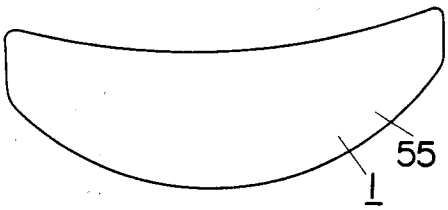
FIG. 33 is a front view of a breast covering according to an embodiment of the invention.
Figure 34:
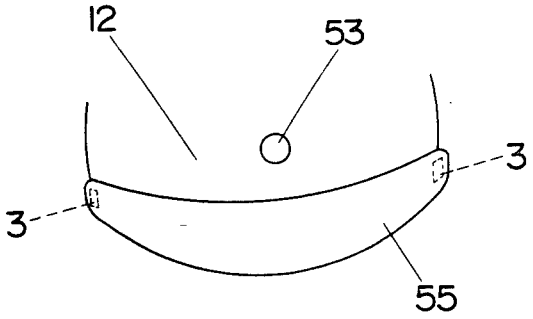
FIG. 34 is a schematic view showing said breast covering in its worn position.
Figure 35:
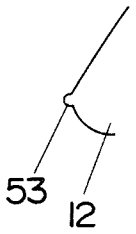
FIGS. 35*a* and 35*b* are schematic views showing said breast covering before and during use.
Figure 35:
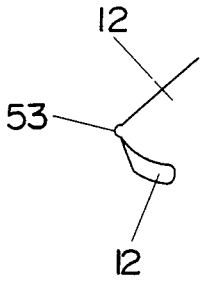

FIG. 33, 34 and 35 show, as an embodiment of the invention, a breast covering 55 adapted to be attached below the breast to raise the latter. The breast covering 55 is substantially semicircular or crescent-shaped, and various colors may be used as in the preceding embodiment. In use, as shown in FIG. 34, retainers 3 are stuck below the breast 12 at least on both sides thereof, and with the breast raised, the breast covering 55 is applied to cover the lower half of the breast 12, with the fastening means engaged with the mating fastening means so as to hold the breast 12 in the raised position (i.e., in good shape) by the breast covering 55.

Figure 36:
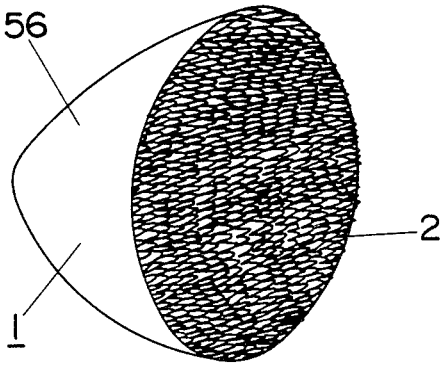
FIG. 36 is a perspective view of a breast covering according to an embodiment of the invention.
Figure 37:
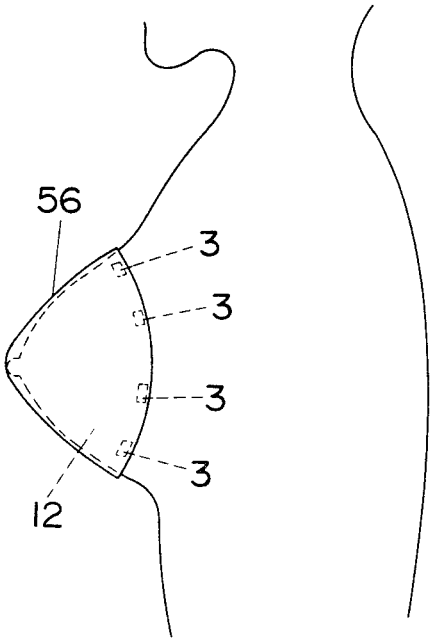
FIG. 37 is a schematic view showing said breast covering in its worn position.

FIG. 36 and 37 show, as an embodiment of the invention, a cup-shaped breast covering 56 for covering substantially all of the breast 12. As shown in FIG. 37, the breast covering 56 is mounted in position by sticking retainers 3 around the breast 12 and fitting the breast covering 56 over the breast 12 to bring the fastening means 2 into engagement with the mating fastening means.

Figure 38:
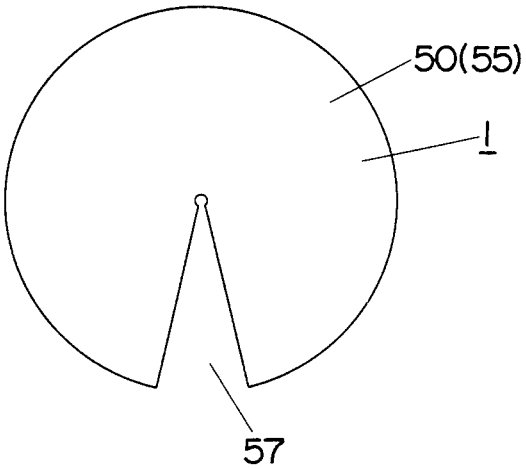
FIGS. 38*a* and 38*b* are a front view and a perspective view, respectively, of a breast covering according to an embodiment of the invention, the latter view showing said covering in its cup-shaped states.
Figure 38:
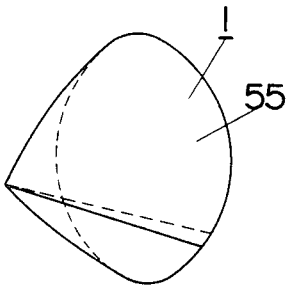

If the breast covering 56 of such a size as to cover substantially all of the breast 12 and the breast covering 50 of such a size as to cover the nipple 53 and the region therearound have the shape of a notched circle, as shown in FIG. 38, they can be formed substantially into a cup by abutting or overlapping the opposite end portions of the notch 57 or they can be made to fit to various sizes of breasts 12 of their crest portions by selecting suitable ways of overlapping.

Figure 40:
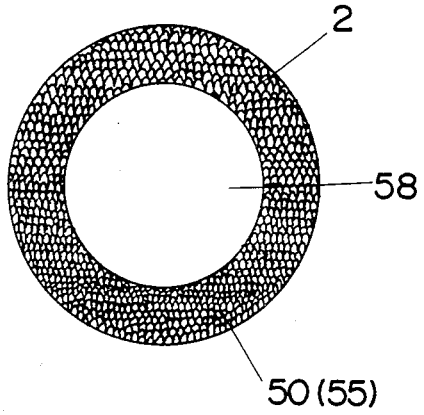
FIG. 40 is a rear view of another example of a breast covering.

The breast coverings are preferably soft. Further, as shown in FIG. 40, the back side of the breast covering 50 or 55 may be provided, at the region which contacts the nipple, with a protector 58 which is soft and agreeable to the touch.

Figure 41:
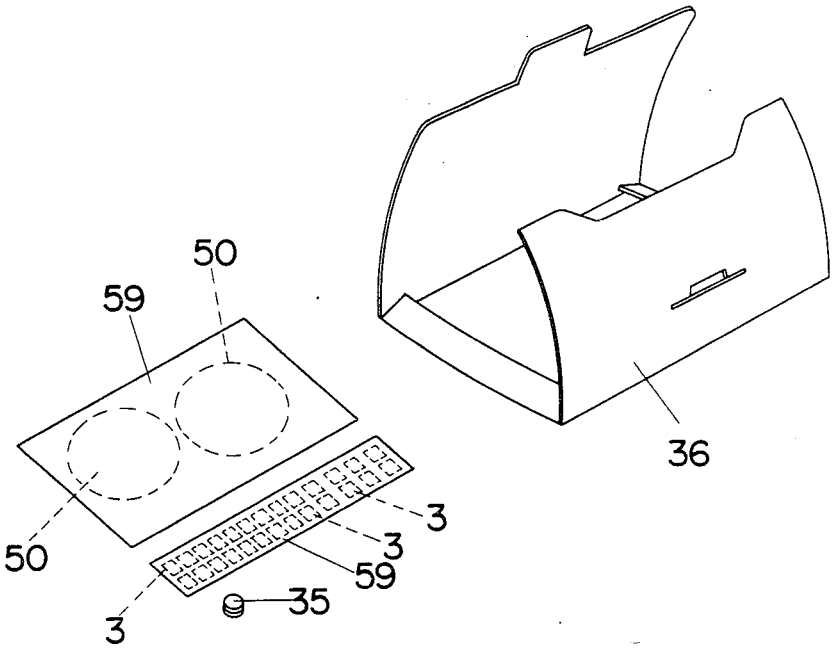
FIG. 41 is an exploded perspective view of a package containing said breast covering.

As in the previous embodiments, each of the breast coverings 50, 55 and 56 in the above embodiments is contained in a package 36 together with a number of retainers 3 and test peices 35, as shown in FIG. 41 and put on the market. Thus, after the user has ascertained that the pressure sensitive adhesive agent used will not cause allergy to her by means of the test pieces 35, she can use the breast coverings 50, 55 and 56. The numeral 59 denotes protective sheets in which the breast coverings 50 and retainers 3 are wrapped.

As described above, in the embodiments of the invention in which the personal wearing article main body is a breast covering, the back side of the breast covering for covering the women's breasts is provided with fastening means, the front side of the sheet-like retainer positioned backwardly of the breast covering is provided mating fastening means, and the back side of the retainer is provided with a pressure sensitive adhesive agent layer for sticking the retainer on the user's body. Therefore, the breasts can be beautifully shaped by covering the nipples and breasts with the breast covering. Moreover, since there is no need for shoulder strings like those required by brassieres, there is an advantage that even a garment having no portion which covers the shoulders, such as a tank top dress, may be worn. Further, by wearing the breast coverings under a bathing suit at the time of swimming, the shape of the breasts can be corrected and pleasant swimming can be enjoyed. Further, the retainer is provided with a pressure sensitive adhesive agent layer and if the pressure sensitive adhesive agent layer becomes deteriorated and no longer usable, the retainer alone may be discarded while the breast covering can be used any number of times. Since there is no pressure sensitive adhesive agent layer on the breast covering, there is an advantage that there is no trouble in laundering.

What is claimed is:

1. A two-piece breast undergarment comprising a breast covering and a sheet-like retainer, said breast covering having fastening means on the back side thereof, said retainer having mating fastening means on the front side thereof and a pressure-sensitive adhesive layer on the back side thereof for attaching said retainer to the human body, wherein said fastening means comprise a number of loops, said mating fastening means comprise a number of linear rods having front end hooks engageable with said loops of said fastening means, and said mating fastening means are removably fastened to said fastening means.

2. A breast undergarment as set forth in claim 1, wherein the material for the breast covering itself serves as said fastening means.

3. A breast undergarment as set forth in claim 1, wherein the material for the retainer itself serves as said mating fastening means.

4. A breast undergarment as set forth in claim 1 or 3, wherein the pressure sensitive adhesive layer on the back side of the retainer has a release paper sheet applied thereto.

5. a breast undergarment as set forth in claim 1, wherein the breast covering is made of synthetic resin.

6. A breast undergarment as set forth in claim 1, wherein the breast covering is formed of a woven fabric.

7. A breast undergarment as set forth in claim 1, wherein the breast covering is formed of a knit fabric.

8. A breast undergarment as set forth in claim 1, wherein the breast covering is formed of a non-woven fabric.

9. A breast undergarment as set forth in claim 1, 5, 6, 7 or 8, wherein the breast covering is formed of a soft sheet.

10. A breast undergarment as set forth in claim 9, wherein the breast covering is formed of a soft sheet and has such a size as to cover the nipple.

11. A breast undergarment as set forth in claim 9, wherein the breast covering has such a size as to cover substantially the lower half of the breast.

12. A breast undergarment as set forth in claim 9, wherein the breast covering has such a size as to cover substantially all of the breast.

13. A breast undergarment as set forth in claim 12, wherein the breast covering is cup-shaped.

14. A breast undergarment as set forth in claim 1, wherein the material for said breast covering is a woven fabric which provides said fastening means.

15. A breast undergarment as set forth in claim 1, wherein the material for said breast covering is a knit fabric which provides said fastening means.

16. A breast undergarment as set forth in claim 1, wherein said retainer has a size much smaller than said breast covering.

17. A breast undergarment as set forth in claim 1, wherein a plurality of said retainers are removably fastened to said breast cover.

18. A strapless two-piece breast undergarment comprising a reusable breast covering and disposable sheet-like retainer; said breast covering having fastening means comprising a number of loops on the back side thereof; said retainer having mating fastening means comprising a number of linear rods having front end hooks engageable with said loops of said fastening means on the front side thereof and a pressure sensitive adhesive on the back side thereof for attaching the retainer to the human body, wherein said mating fastening means are removably fastened to said fastening means.

* * * * *